US005211398A

United States Patent [19]

Awano et al.

[11] Patent Number: 5,211,398

[45] Date of Patent: May 18, 1993

[54] HOLLOW TENNIS RACKET FRAME WITH MATCHED FREQUENCY OF VIBRATION

[75] Inventors: Tetsuyuki Awano; Masanori Takatsuka, both of Shizuoka, Japan

[73] Assignee: Yamaha Corporation, Japan

[21] Appl. No.: 530,439

[22] Filed: May 29, 1990

Related U.S. Application Data

[63] Continuation of Ser. No. 312,736, Feb. 17, 1989, abandoned.

[30] Foreign Application Priority Data

Feb. 19, 1988 [JP] Japan ..... 63-37253

[51] Int. Cl.[5] ..... A63B 49/02

[52] U.S. Cl. ..... 273/73 R; 273/73 C; 273/73 G

[58] Field of Search ..... 273/73 C, 73 F, 73 G, 273/73 H, 73 J, 73 K, 73 R

[56] References Cited

U.S. PATENT DOCUMENTS 4,165,071 8/1979 Frowlow ..... 273/73 C
4,664,380 5/1987 Kuebler ..... 273/73 G
4,768,786 9/1988 Kuebler ..... 273/73 C

FOREIGN PATENT DOCUMENTS 104930A 4/1984 European Pat. Off. ..... 273/73 R

*Primary Examiner*—V. Millin
*Assistant Examiner*—William M. Pierce
*Attorney, Agent, or Firm*—Ostrolenk, Faber, Gerb & Soffen

[57] ABSTRACT

A tennis racket frame having the head and shaft, preferably made of a hollow FRP material, have uniform thickness along the longitudinal direction of the racket frame in a range from 23 to 28 mm with a natural frequency in a range from 160 to 260 Hz. Raised product of the Young's modulus (E) and moment of inertia of area (I) of the racket frame much improves its repulsion characteristics for long distance shot accurately in an intended direction. The specified natural frequency makes the vibrately performance of the racket frame very close to that of balls just after striking so that the vibration energy of the racket frame should be efficiently utilized for acceleration of balls. Further, the increased thickness of the head end assures raised accuracy in striking even when a ball is struck by a section of the face near the head end.

12 Claims, 3 Drawing Sheets

HOLLOW TENNIS RACKET FRAME WITH MATCHED FREQUENCY OF VIBRATION

This is a continuation of application Ser. No. 07/312,736 filed on Feb. 17, 1989now abandoned.

BACKGROUND OF THE INVENTION

The present invention relates to an improved racket frame, and more particularly relates to improvement in the ball-striking characteristics of a racket frame used for ball games such as tennis.

A racket frame of this type has a general construction in which a head is connected to a grip via a shaft including a throat the head having a substantially oval shape defining a face formed by a latticework of strings held in tension. The head is made up of a crown and shoulders.

When a ball is struck by such a racket frame, the ball and the racket frame vibrate in different modes of vibration soon after contact of the ball with the face of the racket frame.

In the case of most conventional racket frames, the thickness of the frame, i.e. the dimension of the racket as measured in a direction perpendicular to the plane of the face is about 18 mm or less and is uniform over the entire length of the frame. This small thickness attenuates abrupt decay of vibration after the racket face has struck a ball. In addition, the racket frame is usually designed to have a natural frequency in a range from 90 to 140 Hz. Such a low natural frequency of the racket frame causes a big difference in the vibratory performance between the ball and the racket frame and, as a consequence, the vibratory energy of the racket frame cannot be efficiently utilized for to accelerate the ball by repulsion.

In an attempt to overcome these disadvantages, a new racket frame is proposed in U.S. Pat. No. 4,664,380. In one embodiment of this prior proposal, the thickness of the racket frame increases gradually from the joint of the shaft with the grip, reaches the largest value about the middle of the length of the head and decreases gradually towards the head end. By so varying the thickness along the longitudinal direction of the racket frame, it is intended to make the natural frequency of the racket frame closer to the excitation frequency of balls.

With such a construction of the prior proposal, however, vibration of the racket frame abruptly decays when a ball is struck by a section of the face close to the head end due to the reduced thickness of the frame in that area. Such abrupt attenuation in vibration results in a low flying speed of the ball and poor accuracy in striking. Thus, the ball cannot fly a long distance in an intended direction.

SUMMARY OF THE INVENTION

It is the object of the present invention to assure a high flying speed of a ball and rich accuracy in striking even when the ball is struck near the head end of a racket frame.

In accordance with the basic aspect of the present invention, a racket frame has a uniform thickness in the longitudinal direction in a range from 23 to 28 mm with a natural frequency in a range from 160 to 260 Hz.

DESCRIPTION OF THE PREFERRED EMBODIMENTS

Figure 1:
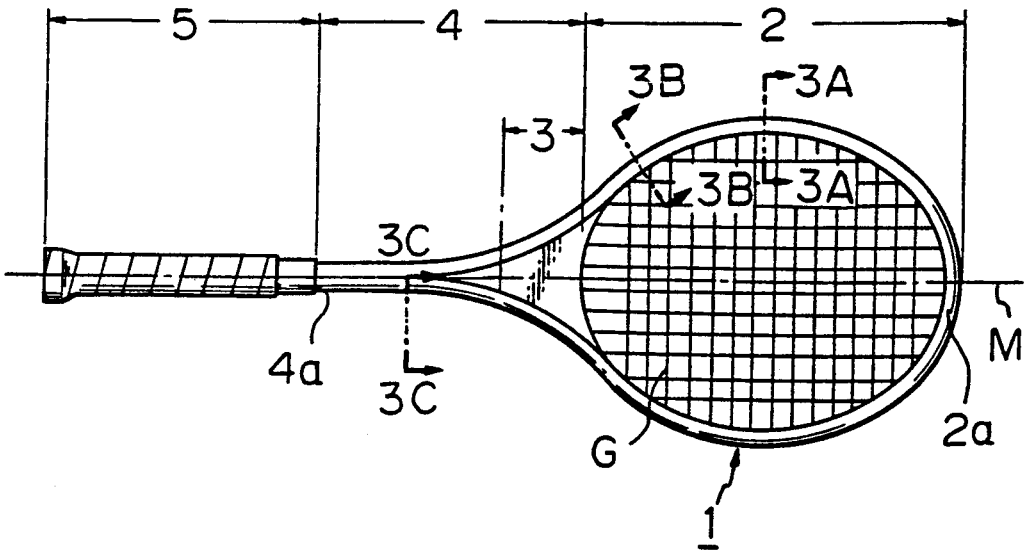
FIG. 1 ia a plan view of one embodiment of the racket frame in accordance with the present invention.
Figure 2:
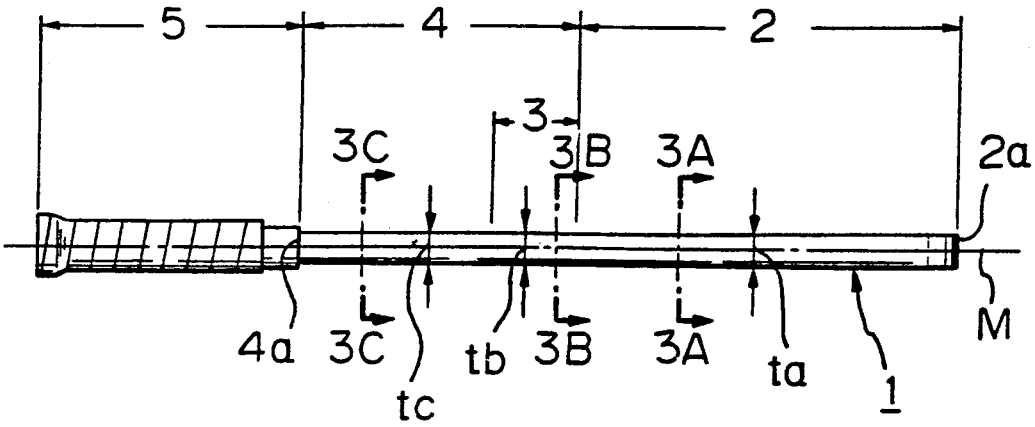
FIG. 2 is a side view of the racket frame.

As shown in FIGS. 1 to 3C, the racket frame 1 in accordance with the present invention is made of an elongated fiber reinforced plastic (FRP) material of a hollow construction. The racket frame 1 is further made up of a head 2 defining a face G, a shaft 4 connected to the head 2 via a throat 3, and a grip 5 connected to the shaft 4 at its grip attachment point 4*a*. The head 2 has a thickness ta, the throat 3 has a thickness tb and the shaft 4, excluding the throat 3, has a thickness tc. These thicknesses ta to tc are all chosen in a range from 23 to 28 mm, more preferably from 23 to 26 mm.

Figure 3A:
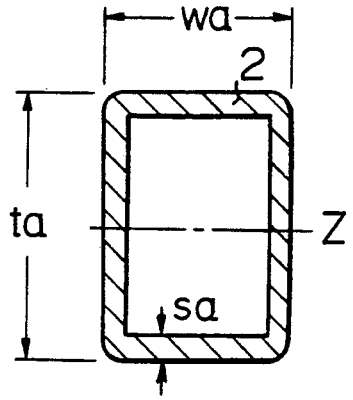
FIG. 3A to 3C are transverse cross-sectional views taken along lines A—A, B—B and C—C in FIG. 2, and FIG. 4, shows one example of the system for measuring the primary natural frequency of a racket.
Figure 3B:
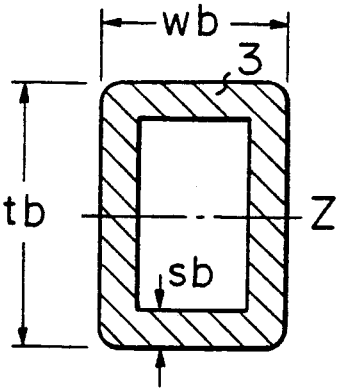
Figure 3C:
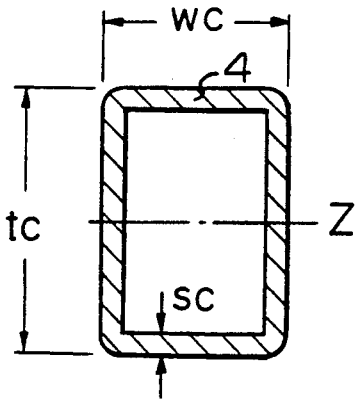

As shown in FIGS. 3A to 3C, the head 2 has a wall thickness sa, the throat 3 has a wall thickness sb and the shaft 4 has a wall thickness sc. The wall thickness sb of the throat 3 is designed larger that those the thicknesses sa and sc of the head 2 and the shaft 4 so that the natural frequency of the racket frame 1 is in a range from 160 to 260 Hz, more preferably from 180 to 240 Hz. Such wall thickness adjustments can be carrier out as described by properly selecting the number of resin impregnated sheets which are to be superimposed on each other when forming the hollow FRP material. For example, 5 to 8 sheets are used for the grip 5 and the shaft 4 excluding the throat 3 or head 2, and 12 to 20 sheets are used for the throat 3.

Again as shown in FIGS. 3A to 3C, the head 2 has a width wa, the throat 3 has a width wb and the shaft 4 has a width wc. These widths should preferably be in a range from 9 to 15 mm. Further, the ratio between the wall thickness Sb of the throat 3 and the wall thickness Sa of the head 2 should preferably be in a range from 2 to 4, more preferably from 2 to 3. The widths and wall thicknesses should be chosen in combination with each other so that the moment of inertia of area (I) on neutral axis Z of entire racket frame 1 should be 2 to 5 times larger than those of the conventional racket frames.

In accordance with the present invention, the various dimensions and the natural frequency of the racket frame are specified to the above-described values for the following reasons. The excitation characteristics of a racket frame are greatly influenced by the natural frequency of the racket frame, and by a product of the Young's modulus (E) of the material of the racket frame and the moment of inertia of area (I) of the racket frame. As well known, the moment of inertia of area (I) of a mass is fixed by the thickness, width and height of the mass. The thickness refers to the size of the mass as measured in a direction normal to its neutral axis and the width refers to the size of the mass as measured in a direction parallel to its neutral axis. The wall thickness is also a factor when the mass is hollow. In the case of the present invention, the neutral axis Z runs in a direction parallel to the face defined by the head of the racket frame and the moment of inertia of area (I) is fixed with respect to such a neutral axis Z.

The following relationships exists between the Young's modulus (E), the moment of inertia of area (I) and the natural frequency (F) of a racket frame.

$$F \propto \sqrt{K/M} \quad (1)$$

$$K \propto E - I \quad (2)$$

where

K; Spring constant

M; Weight

In one preferred embodiment of the present invention, the throat 3 and the other parts are made of materials of different Young's moduli. For example, the throat 3 is made of a high grade type CFRP (carbon fiber reinforced plastics) having a Young's modulus of 500 GPa whereas the other parts are made of a normal grade type CFRP having a Young's modulus of 220 GPa.

Figure 4:
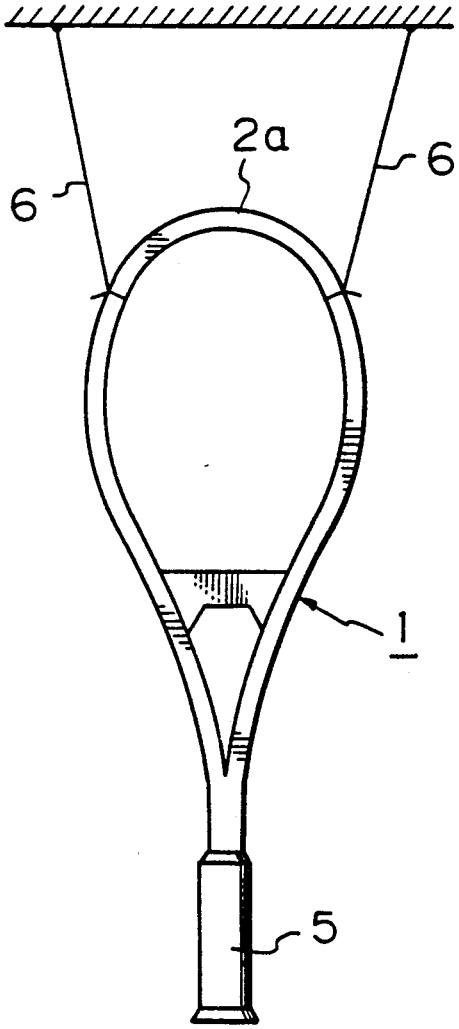

One example of the system for measuring the primary natural frequency of a racket is shown in FIG. 4. For correct measurement, the racket frame has to be held in a manner to exclude factors affecting the natural frequency of the racket frame. To this end, a racket frame 1 without strings is supported by a pair of rubber cords 6 each connected to a point on the racket frame 1 which corresponds to a node of the primary made of natural vibration. To generate vibrations, the head end 2*a* of the racket frame 1 is struck by, for example, a plastic hammer. To measure frequency, an acceleration meter is attached to the racket frame 1 at the head end 2*a* on the face opposite to the struck face.

As an alternative, the racket frame 1 may be supported by a single rubber cord connected to a point which corresponds to the node of primary natural vibration.

According to one aspect of the present invention, the natural frequency (F) of the racket frame is set to a value in a range from 160 to 260 Hz. With such a specified range, the natural frequency (F) of the racket frame is made very close to the excitation frequency of balls to be struck by the face of the racket frame and, as a consequence, the position resumed by the face at the time the ball is struck closely matches the position of the ball at the time it is released from the face. Thus, the vibratory performance of the racket frame is efficiently transmitted to the ball so that the vibration energy of the racket frame is very efficiently utilized for acceleration of the ball by repulsion. In addition, the ball can fly accurately in the direction intended by the player.

According to another aspect of the present invention, a racket frame has a uniform thickness along the longitudinal direction. In particular the head end 2*a* of the racket frame is much thicker than that of the conventional racket. As a result, vibrations of the racket frame decay gradually even when a ball is struck by a section of the face close to the head end 2*a*. Such attenuation in vibrations results in high flying speed of the ball and rich accuracy in striking. Thus, the ball can fly a long distance in an intended direction.

In accordance with another aspect of the present invention, the wall thickness and/or Young's modulus (E) of the throat 3 are designed larger than those of the shaft 4, excluding the throat 3 and the grip 5, to adjustable head 2 the natural frequency. Additionally, the moment of inertia of area (I) and/or the product of the moment of inertia of area (I) and Young's modulus (E) of the throat 3 may be designed so that it is larger than the natural frequency of the racket frame can be easily set to a value in a specified range without varying its thickness along the longitudinal direction thereof.

We claim:

1. A racket frame comprising a head having a face, a shaft including a throat and a grip, the frame having a natural frequency of vibration and a node corresponding to said natural frequency of vibration said head, said shaft and said grip having respective external dimensions of width and thickness; the respective thicknesses of said head, said shaft and said grip being substantially equal along the direction of said racket frame extending from said grip to said head in a range from 23 to 28 mm with a natural frequency, as measured with the racket frame supported at the node and the head and the grip of the racket frame supported, in a range from 160 to 260 Hz, said head, said shaft including said throat and said grip having respective hollow cross-sections and each being defined by walls having respective thicknesses, the wall thickness of said throat being larger than the respective wall thicknesses of said head and said shaft excluding said throat.

2. A racket frame as claimed in claim 1 in which a product of the Young's modulus of the material and the moment of inertia of area of said throat is larger than the respective products of Young's modulus and moment of inertia of said head, said shaft excluding said throat and said grip.

3. A racket frame as claimed in claim 1 in which the moment of inertia of area (I) of said throat is larger than the respective moments of inertia of said head, said shaft excluding said throat and said said grip.

4. A racket frame as claimed in claim 1 in which the Young's modulus (E) of said throat is larger than the respective Young's moduli of said head, said shaft excluding said throat and grip.

5. A racket frame as claimed in claim in which the width of said head and shaft including said throat as measured in the plane of the face of said head is in a range from 9 to 15 mm.

6. A racket frame as claimed in claim 1 in which said head and said shaft are made of an elongate FRP material.

7. A racket frame as claimed in claim 6 in which the ratio of the wall thickness of said throat with respect to that of said head is in a range from 2 to 4.

8. A racket frame as claimed in claim 6 in which a product of the Young's modulus of the material and the moment of inertia of area of said throat is larger than the respective products of Young's modulus and moment of inertia of said head, said shaft excluding said throat and said grip.

9. A racket frame as claimed in claim 6 in which the moment of inertia of area (I) of said throat is larger than the respective moments of inertia of said head, said shaft excluding said throat and said grip.

10. A racket frame as claimed in claim 6 in which the Young's modulus (E) of said throat is larger than those respective Young's moduli of said head, said shaft excluding said throat and said grip.

11. A racket frame as claimed in claim 10 in which the Young's modulus (E) of said throat is 500 GPa and the Young's moduli of said shaft and said grip are 220 GPa.

12. A racket frame as claimed in claim 6 in which the width of said head and shaft including said throat as measured in the plane of the face of said is in a range 9 to 15 mm.

* * * * *